United States Patent [19]

Thumma

[11] Patent Number: 4,867,690

[45] Date of Patent: Sep. 19, 1989

[54] ELECTRICAL CONNECTOR SYSTEM

[75] Inventor: Mark R. Thumma, Oberlin, Pa.

[73] Assignee: AMP Incorporated, Harrisburg, Pa.

[21] Appl. No.: 208,319

[22] Filed: Jun. 17, 1988

[51] Int. Cl.[4] ..... H01R 9/09

[52] U.S. Cl. ..... 439/79; 439/631

[58] Field of Search ..... 439/79–82, 439/631

[56] References Cited

U.S. PATENT DOCUMENTS

| | | | |
|---|---|---|---|
| 3,192,445 | 6/1965 | Evans et al. | 317/101 |
| 3,864,000 | 2/1975 | Coller et al. | 439/79 |
| 4,196,957 | 4/1980 | Benasutti | 439/79 |
| 4,582,386 | 4/1986 | Martens | 439/631 |
| 4,639,056 | 1/1987 | Lindeman et al. | 439/79 |
| 4,655,518 | 4/1987 | Johnson et al. | 339/17 LC |
| 4,660,911 | 4/1987 | Reynolds et al. | 339/17 LC |

OTHER PUBLICATIONS

AMP Instruction Sheet 7042—Released 3/25/63, AMP Meca Assembly Instructions.

Publication entitled "Steckverbinder für Oberflä chen-montage, " 5/1987, Czeschka.

Teradyne Technical Bulletin No. 237, Jan. 29, 1985 Teradyne Connection Systems, Inc., p. 8.

*Primary Examiner*—P. Austin Bradley

*Attorney, Agent, or Firm*—Allan B. Osborne

[57] ABSTRACT

An electrical connector system for electrically connecting circuits on a backplane and daughtercard. More particularly, the connector system includes two mating connectors having engaging conductive contacts for carrying signals, power and providing ground reference planes as required. One connector is mounted on the backplane and the other is mounted on the daughtercard so that the circuits thereon are electrically connected upon mating the two connectors.

2 Claims, 4 Drawing Sheets

14
46
48b
60
40
42
44
10
38
48a
40
60
46
18c
24
22a
12
30
18b
18a
18
30
20
22b
32
26
28
16
34

ELECTRICAL CONNECTOR SYSTEM

FIELD OF THE INVENTION

This invention relates to a connector system for electrically interconnecting circuits on a backplane and on a daughter card.

BACKGROUND OF THE INVENTION

Backplanes provide both a physical support for and circuitry to electrically interconnect a number of daughter cards having electronic components mounted thereon. Of the several ways of mounting daughter cards on a backplane, a two-piece, multiple-contact connector system offers advantages not otherwise available. One such system is made and sold by AMP Incorporated of Harrisburg, PA, under the Trademark "AMP HDI Two Piece PC Board Connector".

One connector, the "pin header", is plugged into or otherwise attached to the backplane and the mating second connector, the "receptacle", is plugged into or otherwise attached to the daughter card. When the two connectors are removably joined or mated, circuits on the backplane and daughter card are electrically connected through the engaging contacts in the joined connectors.

As disclosed in U.S. Pat. No. 4,655,518, a two-piece connector was modified by providing grounding contacts along the plastic sidewalls of the respective connectors. The contacts in the pin header are positioned in recesses in an inside surface of a sidewall with the contact portion thereof; i.e., a convex-shaped, single resilient beam, facing inwardly towards the signal pins positioned between the sidewalls. The ground contacts in the receptacle were placed along the outside surface of a sidewall so that they would slidingly engage the resilient beams in the pin header when the connectors were joined. The normal force between the engaged ground contacts is obtained by the beam being pushed against the sidewall.

As is well known, plastic under compression tends to soften in warm environments and the sidewall loses some of its ability to support the beams adequate. Thus, the normal force drops off, reducing the ability of the engaging contacts to transmit electrical current therethrough. Accordingly, it is now proposed to provide a connector system, of the type described above, wherein the normal forces between all the contacts are achieved from the structure of the contacts themselves and do not rely on the plastic sidewalls.

SUMMARY OF THE INVENTION

According to the invention, an electrical connector system for providing reliable electrical engagement between all mating conductive contacts is disclosed. Contacts in one connector include posts extending into a cavity into which the other connector is inserted. The other connector includes contacts having post-gripping receptacles positioned in passages and in slots located in the outside surfaces of the sidewalls.

BRIEF DESCRIPTION OF THE INVENTION

FIG. 1 is a perspective view of the electrical connector system of the present invention;

FIG. 2 is a cross-sectional view of the connector system shown in FIG. 1;

FIG. 3 is a perspective view of a contact of one of the connectors of the connector system;

FIG. 4 is a cross-sectional view of two joined connectors of the connector system; and FIG. 5 is a cross-sectional view of another embodiment of one of the connectors of the connector system.

Figure 1:
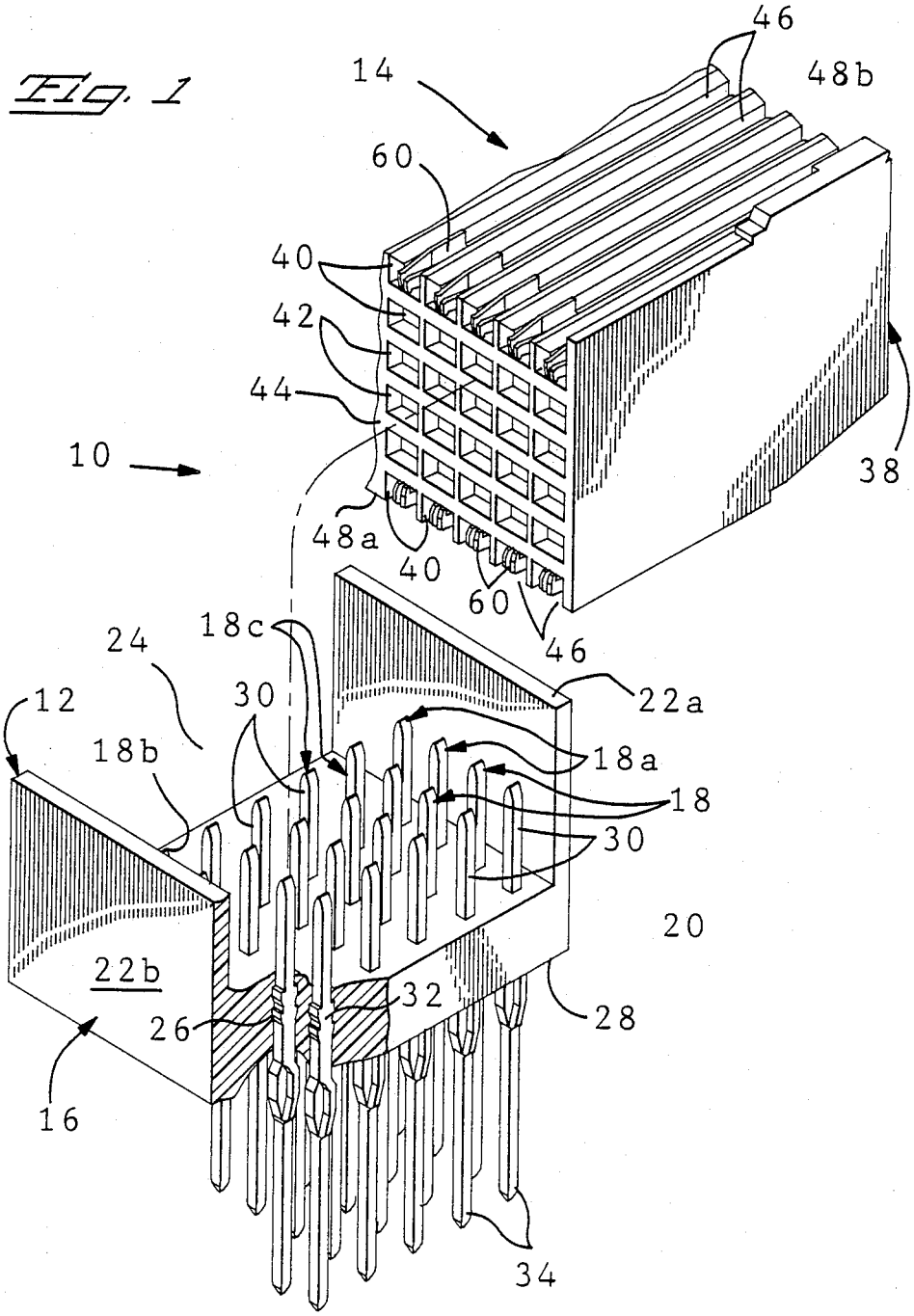
As shown in FIG. 1, electrical connector system 10 of the present invention include first connector 12; i.e., a "pin header", and second connector 14; i.e., a "receptacle". First connector 12 includes a dielectric housing 16 and a plurality of conductive contacts 18, hereinafter referred to as ground pins 18a, power pins 18*b* and signal pins 18*c*. Housing 16 is preferably molded from a polyester plastic; e.g., such as sold by the General Electric Company under the trademark "VALOX". Structurally, housing 16 includes base 20, sidewalls 22*a* and *b*, and end walls (not shown), all of which cooperate to define upwardly open cavity 24.

Base 20 is provided with several passages 26 extending normally therethrough and opening out into cavity 24 and oppositely facing surface 28. Disposed in passages 26 are the aforementioned pins 18 which include posts 30 projecting into cavity 24, retention sections 32 which retain pins 18 in passages 26 and leads 34 which extend outwardly from surface 28 for receipt in respective holes in a backplane (not shown). In the embodiment shown, pins 18 are arranged in rows of six extending across the width of cavity 24 and columns extending along the length of cavity 24. Pins 18*a*, located adjacent sidewall 22*a*, generally are used as ground reference paths. Pins 18*b*, located adjacent sidewall 22*b*, generally are used to carry power. Pins 18*c*, located between pins 18*a* and *b*, generally carry signals. However, as is well known, any pin 18 can be assigned anyone of the three functions as conditions and circuit layouts require.

Pins 18 are preferably stamped and formed from a suitable conductive metal such as phosphor bronze.

Second connector 14 includes housing 38 and a plurality of conductive contacts 40*a*, 40*b* and 40*c* (collectively 40). Housing 38, preferably molded from the aforementioned polyester plastic, includes a plurality of passages 42 which open onto front mating surface 44. Slots 46 are provided in each outer surface of sidewalls 48*a* and 48*b* (collectively 48). Passages 42 and slots 46 are on the same pattern defined by passages 26 of first connector 12.

Figure 2:
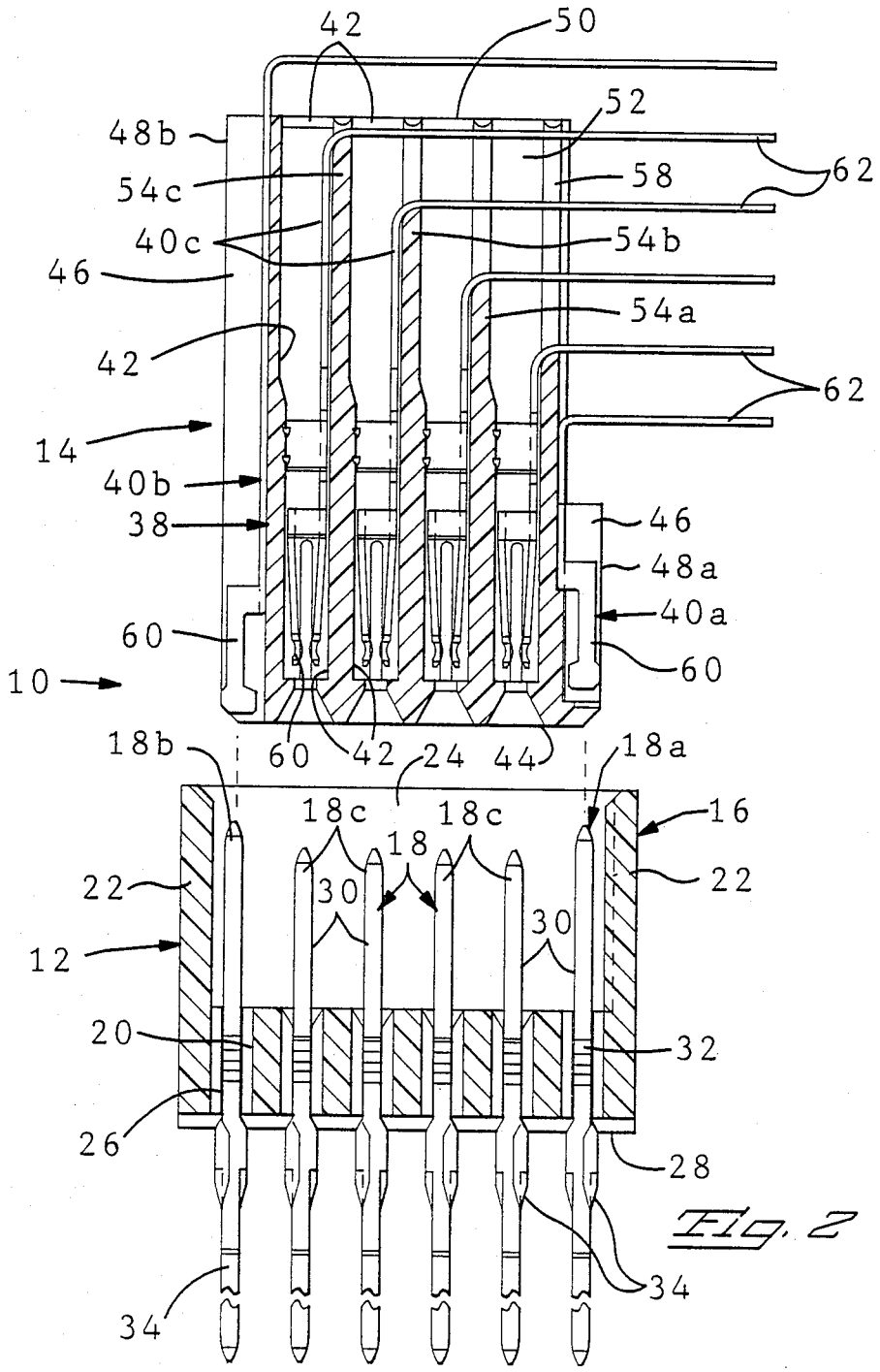

As shown in FIG. 2, passages 42 extend towards rear surface 50 of housing 38 where they are defined by transverse walls 52, and partitions 54*a*, *b* and *c* (collectively 54) as well as by sidewalls 48*a*, *b*. Sidewalls 48*a*, *b* and partitions 54a, b, c increase in length from front surface 44 towards rear surface 50. Each passage 42 opens onto surface 50 and to space 58 between sidewall 48*a* and surface 50.

Figure 3:
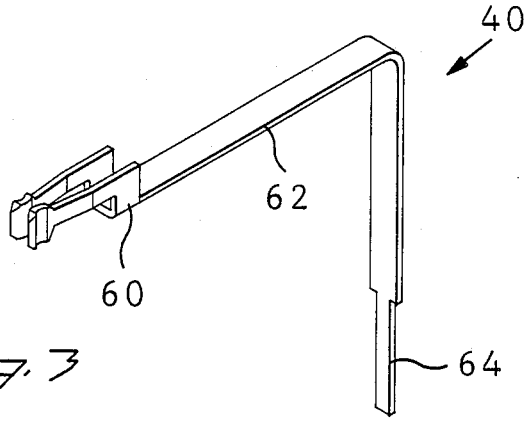

Contacts 40, more clearly shown in FIG. 3, include a receptacle 60 and, extending rearwardly therefrom, a lead 62 which may be reduced in size at its free end 64. Ground contacts 40*a* mate with pins 18*a* when connectors 12 and 14 are joined and are located in slots 46 in sidewalls 48*a*. Contacts 40*b* are located in slots 46 in sidewall 48*b* and mate with pins 18*b*. Contacts 40*c*, located in passages 42, mate with pins 18*c*. Leads 62 extend outwardly through space 58 for insertion into holes in a daughter card (not shown). In assmebling connector 14, contacts 40*a*, *b* and *c* are loaded into slots 46, passages 42 respectively from rear surface 50 with leads 62 already bent ninety degrees. In the alternative, contacts 40 are loaded into housing 38 with leads 62 straight and which are then bent over the terminal ends of sidewall 48*a* and partitions 54*a, b, c.* Contacts 40 are retained in slots 46, passages 42 in any one of well known methods of retention.

Contacts 40 are preferably stamped and formed with the material being beryllium copper or the like.

Figure 4:
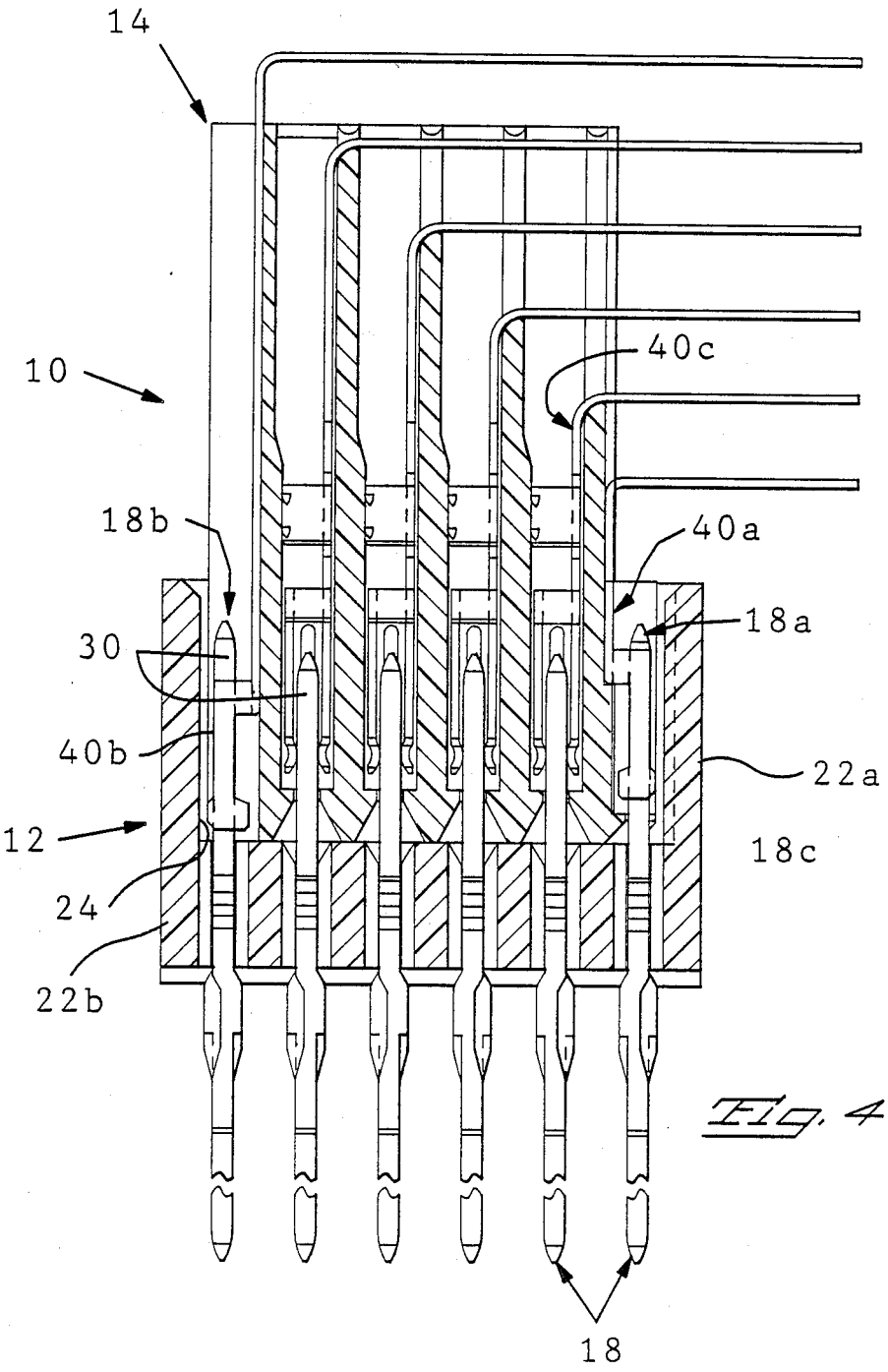

In use, first connector 12 is mounted on a backplane (not shown) with leads 34 on pins 18 being inserted into holes therein. Alternatively, modified leads (not shown) could be soldered onto circuit pads (not shown) on the backplane. Second connector 14 is mounted onto a daughter card (not shown) with leads 62 on contacts 40 being inserted into holes therein. As is well known in the art, leads 34 and 62 electrically contact circuits on and within the backplane and card respectively. Thus, upon inserting connector 14 into cavity 24 of connector 12 as shown in FIG. 4, posts 30 of pins 18 enter receptacles 60 of contacts 40 to electrically connect the aforementioned circuits. The positive gripping action by the beams on receptacles 60 result in high normal forces being directly imposed on posts 30 and thus the normal force is not dependent on outside agents. Further, misalignment problems, particularly between pins 18*a,b* and contacts 40*a, b,* are avoided.

As shown in FIG. 4, the contacting point between all receptacles 60 and posts 30 in mated connectors 12,14 is near the floor of cavity 24 and accordingly are well shielded from the environment by sidewalls 22*a, b* of connector 12.

Figure 5:
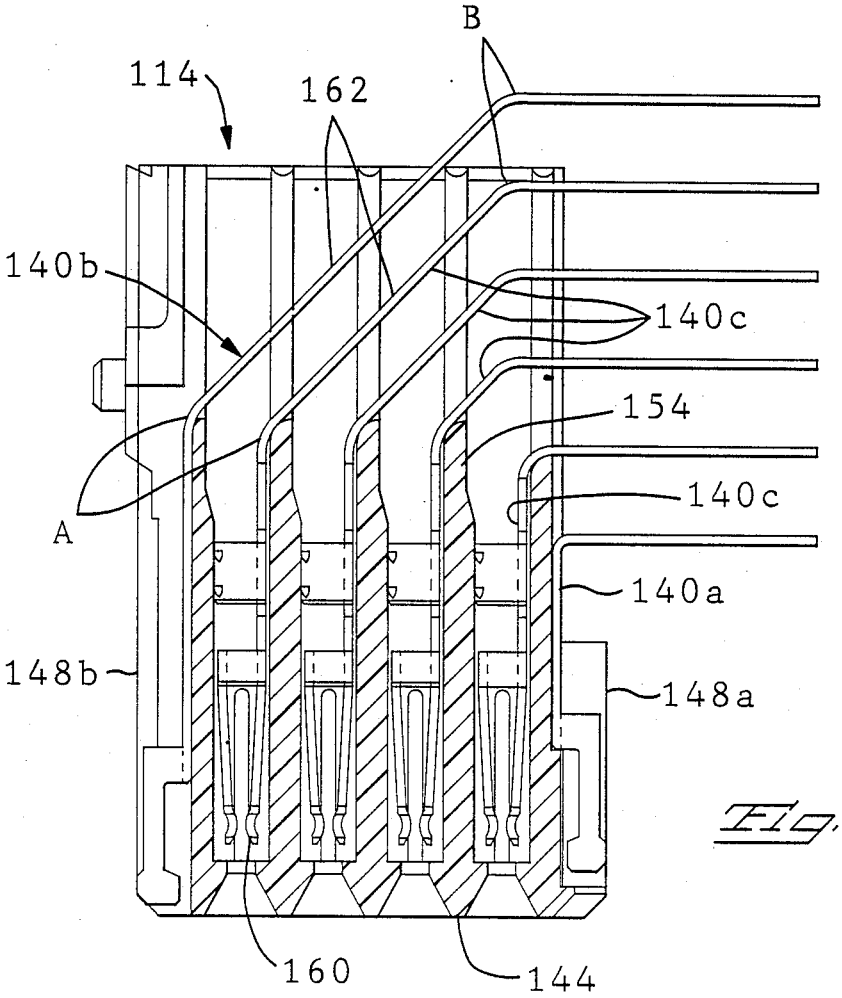

As shown in FIG. 2, leads 62 on contacts 40 are bent ninety degrees to extend out through space 58. FIG. 5 discloses second connector 114 wherein sidewalls 148 and partitions 154 terminate rearwardly at the same distance from front surface 144. Further, except for ground contact 140*a* and the first signal contact 140*b* on the right hand side, leads 162 are bent at points A and B with each bend being approximately forty five degrees. This configuration reduces the length of the leads between the receptacles 160 and the daughtercard and provides the following positive results: Inductance and resistance are lower, resistance and path lengths between rows are more uniform, there is less skewing of signals and the need to de-rate current-carrying capabilities when paralleling contacts is lessened.

As can be discerned, an electrical connector system has been disclosed for electrically connecting circuits on a backplane and on a daughtercard. The connector system includes a first connector having contact posts extending into an open cavity and a second connector having contact receptacles positioned in passages and in slots on the outwardly facing surface of one or both sidewalls. With the first connector mounted on a backplane and the second connector mounted in a daughtercard, circuits are electrically connected through the engaging posts and receptacles upon inserting the second connector into the cavity in the first connector. Signal integrity can be maintained by some of the contacts being connected to ground reference circuits as is well known.

We claim:

1. An electrical connector system for electrically connecting circuits between a backplane and a daughtercard comprising:

a first connector comprising a dielectric housing with an open cavity defined by at least side walls and a plurality of conductive contacts retained in said housing and arranged in elongated rows parallel to said side walls, said contacts having leads extending outwardly from said housing for electrically engaging circuits on the backplane and further having posts extending into said cavity with the posts of the outermost rows being spaced inwardly from said side walls; and a second connector comprising a dielectric housing and a plurality of conductive contacts, said housing having passages therethrough for receiving some of said contacts and slots in outside surfaces of respective sidewalls for receiving other of said contacts, said contacts having receptacles for receiving and compressively gripping said posts when said second connector is inserted into said cavity in said first connector and further having leads attached to and extending from said receptacles for electrically engaging circuits on a daughtercard.

2. An electrical connector system as set forth in claim 1 wherein said leads on said contacts in said second connector are doubly bent to extend outwardly from a side of said housing with each bend being approximately forty five degrees.

* * * * *